US006379817B2

(12) United States Patent
Kufferath

(10) Patent No.: US 6,379,817 B2
(45) Date of Patent: Apr. 30, 2002

(54) METALLIC FABRIC AND MANUFACTURING PROCESS OF A HOLLOW BODY MADE OF A METALLIC FABRIC

(75) Inventor: Ingo Kufferath, Düren (DE)

(73) Assignee: GKD Gebr, Kufferath GmbH & Co., KG, Duren (DE)

( * ) Notice: Subject to any disclaimer, the term of this patent is extended or adjusted under 35 U.S.C. 154(b) by 0 days.

(21) Appl. No.: 09/638,615

(22) Filed: Aug. 15, 2000

Related U.S. Application Data

(60) Provisional application No. 60/152,819, filed on Sep. 7, 1999.

(30) Foreign Application Priority Data

Aug. 16, 1999 (DE) ..... 199 38 135

(51) Int. Cl.[7] ..... B32B 1/06; B32B 15/08; B21F 27/00

(52) U.S. Cl. ..... 428/608; 428/34.1; 245/10; 228/189

(58) Field of Search ..... 428/608, 626, 428/34.1; 228/176, 189; 219/56; 245/10; 210/499, 500.25

(56) References Cited

U.S. PATENT DOCUMENTS

| | | | | | |
|---|---|---|---|---|---|
| 1,935,631 | A | * | 11/1933 | Guba | 245/10 |
| 2,061,454 | A | * | 11/1936 | Crossman | 245/10 |
| 2,078,369 | A | * | 4/1937 | Buchanan | 245/10 |
| 2,116,811 | A | * | 5/1938 | Webb et al. | 245/10 |
| 2,116,812 | A | * | 5/1938 | Webb | 245/10 |
| 2,855,918 | A | * | 10/1958 | Tescula | 126/25 |
| 3,094,302 | A | * | 6/1963 | Stauffer | 245/10 |
| 4,358,371 | A | * | 11/1982 | Jameson et al. | 210/415 |
| 4,969,999 | A | | 11/1990 | Riddell | 210/497.01 |
| 5,032,272 | A | * | 7/1991 | Mould | 210/486 |
| 5,814,118 | A | * | 9/1998 | Wickland et al. | 55/385.4 |

FOREIGN PATENT DOCUMENTS

| | | | | |
|---|---|---|---|---|
| CH | 156184 | | 1/1932 | |
| DE | 2161352 | * | 6/1972 | |
| DE | G8320438.5 | | 11/1983 | B01D/29/12 |
| GB | 2139131 A1 | * | 11/1984 | |
| GB | 2186211 A1 | * | 8/1987 | |

* cited by examiner

*Primary Examiner*—John J. Zimmerman
(74) *Attorney, Agent, or Firm*—Yongzhi Yang; Steven J. Hultquist; Marianne Fuierer

(57) ABSTRACT

A metallic fabric for manufacturing a hollow body is welded at two edge areas and according to the present invention a metallic strip is welded on in the vicinity of the welded seam, whereby the width of the welded seam is narrower than the width of the metallic strip. An elastic material which flattens out vibrations of the hollow body and ensures protection of the welded seam is arranged between the metallic strip and the metallic fabric.

7 Claims, 1 Drawing Sheet

METALLIC FABRIC AND MANUFACTURING PROCESS OF A HOLLOW BODY MADE OF A METALLIC FABRIC

CROSS-REFERENCE TO RELATED APPLICATIONS

This claims the priority under 35 USC 120 of U.S. Provisional Patent Application No. 60/152,819 filed Sep. 7, 1999, and the priority under 35 USC 119 of German Patent Application No. 199 38 135.6 filed Aug. 16, 1999.

FIELD OF THE INVENTION

The present invention relates to a metallic fabric having two edge areas welded together into a hollow body, and a process for manufacturing a hollow body from a metallic fabric in which two opposite edges of the metallic fabric are welded together.

BACKGROUND OF THE INVENTION

Metallic fabrics are usually manufactured in lengths, as they are made on weaving looms. Fabric pieces are cut to size and welded into a hollow body to manufacture hollow bodies from these lengths.

By way of example, in filter technology metallic fabric tubes are used, during the manufacture of which a metallic length cut at a right angle is bent into a cylinder and the two abutting edge areas are welded together.

With the use of such metallic tubes it has eventuated that the entire fabric resists dynamic loads very well, though the welded seam does represent a weak point. It has been shown that the breaking points of such a bag filter occur mostly in the vicinity of the welded seam, because there the material is compact and alternating loads lead to a break in the adjoining metallic fabric area.

German utility model G 83 20 438 shows the manufacture of a filter bag from a metallic fabric strip. Here, the edge areas of the metallic fabric are not welded to one another, rather they are held together by means of a clamp. The edges are first provided with guy wires and then held together with a C-shaped connecting block. This type of connection allows restricted movement for the metallic fabric edges inside the clamp in order to react to dynamic loads. The fabric, however, breaks in the vicinity of the connection point, and the manufacturing method of the connection is relatively expensive.

SUMMARY OF THE INVENTION

The object of the present invention is to further develop a metallic fabric having two edge areas, welded together into a hollow body, such that the hollow body is resistant to dynamic loads.

This task is solved by a metallic strip being welded in the vicinity of the welded seam and the width of the welded seam being narrower than the width of the metallic strip.

DESCRIPTION OF THE INVENTION AND PREFERRED EMBODIMENTS THEREOF

The basic understanding of the invention is that the greatest alternating tensions originate in the vicinity of the welded seam and these alternating tensions can be distributed to a larger surface by means of a welded metallic strip. Whereas with known hollow bodies made of metallic fabric each distortion of the metallic fabric leads to a bend in the vicinity of the welded seam, the welded metallic strip ensures that the bend is positioned in a area at a distance from the welded seam. The strongest dynamic loads are thereby no longer in the vicinity of the welded seam, but in the vicinity of the metallic fabric. The design of the metallic strip enables the most heavily loaded area of the metallic fabric to be displaced to a larger surface. The metallic fabric is therefore no longer bent in the vicinity of the welded seam, but is gently concealed in the vicinity of the metallic strip. The surface loading is sharply reduced by this, and the application duration of the hollow body is thereby increased.

The metallic strip can be manufactured such that it comprises and elastic area. This elasticity can be achieved by a particularly thin design of the metallic strip, or by partial weaknesses of the strip. The elasticity modulus is to be adjusted such that in the case of alternating loads of the hollow body arising in practice there is minimal deformation of the metallic strip. The deformation energy thus applied is removed from the metallic fabric in the vicinity of the welded seam and no longer has such a destructive effect on the welded seam.

The metallic strip can be welded on the inside and on the outside of the hollow body. Welding on the outside of the hollow body is advantageous since the hollow body is easily accessible here and vibrations arising in practice can be better eliminated with an externally welded metallic strip.

An advantageous embodiment provides for the metallic strip to be designed from angled sheet iron. Angled sheet iron allows the bend arising in practice to be covered over optimally in the vicinity of the welded seam, and enables an arrangement on the metallic fabric which is particularly suited to flattening out the vibrations.

With use of angled sheet iron it is proposed that the angle of the angled sheet iron is an obtuse angle. Such angled sheet iron has been tested and proven to be particularly sound in practice.

It is advantageous if the metallic strip comprises wings on both sides of the welded seam and at a distance from the metallic fabric. These wings allow a gentle transition between the unsupported metallic fabric area and the metallic fabric areas surrounding the welded seam, supported by the metallic strip.

Here, it is an advantage if an obtuse angle or an arc is formed between metallic strip and wing. This leads to a particularly gentle transition between the metallic fabric and the edge of the metallic strip, to the extent that kinks are avoided in this area.

Tests have shown that it is a particular advantage if a ductile material is arranged between metallic strip and metallic fabric. The purpose of this ductile material is to fill out cavities between the metallic fabric and the metallic strip, and to form a flat arrangement between metallic fabric and metallic strip. The forces being exerted between the fabric and the strip are distributed by the ductile material over the largest possible bearing surface and then eliminated through the deformation energy of the material or the strip.

It is an advantage if the ductile materials are elastic, because repeated deformation and vibrations can thereby be optimally deadened.

The task is also solved by a manufacturing process for a hollow body made of a metallic fabric, in which two opposite edges of the metallic fabric are welded together and a metallic strip extending along the welded seam is welded on as the edges are welded together.

Here it is an advantage if a plastic, preferably elastic, material is injected in between metallic strip and metallic fabric after the metallic strip is welded on. The material can be injected in liquid or viscous form and can then harden into a plastic or elastic material. This effectively fills in all the cavities between the metallic strip and the metallic fabric, and the material can create a firm connection between the fabric and the metallic strip by way of its viscous or adhesive properties.

An alternative procedural variant provides for a plastic, preferably elastic, material to be applied to the metallic strip or to the edges of the metallic fabric prior to welding on of the metallic strip. The material can be applied such that there is no materials present directly in the vicinity of the welded seam on the fabric and on the metallic strip. According to choice and thickness of the layer of the material, it can cover the entire surface and can be melted or burnt in during the welding process. The result of using this procedural variant is that the area between the metallic strip and the metallic fabric is well filled with material to guarantee optimal damping properties.

BRIEF DESCRIPTION OF THE DRAWINGS

An embodiment of a fabric according to the present invention is illustrated in the diagram and will now be explained hereinafter in greater detail. In the diagrams:

FIG. 2 is a perspective representation of a metallic fabric with welded-on metallic strip Metallic fabric 1 illustrated in FIG. 1 is shown in section only and the figure also shows two edge areas 2 and 3 of a hollow body 4, which are formed from metallic fabric and are connected to one another by means of a welded seam 5. When edge areas 2 and 3 are welded together, a metallic strip 6, which covers the impact area of edge areas 2 and 3 in the form of a roof, is welded on.

Figure 1:
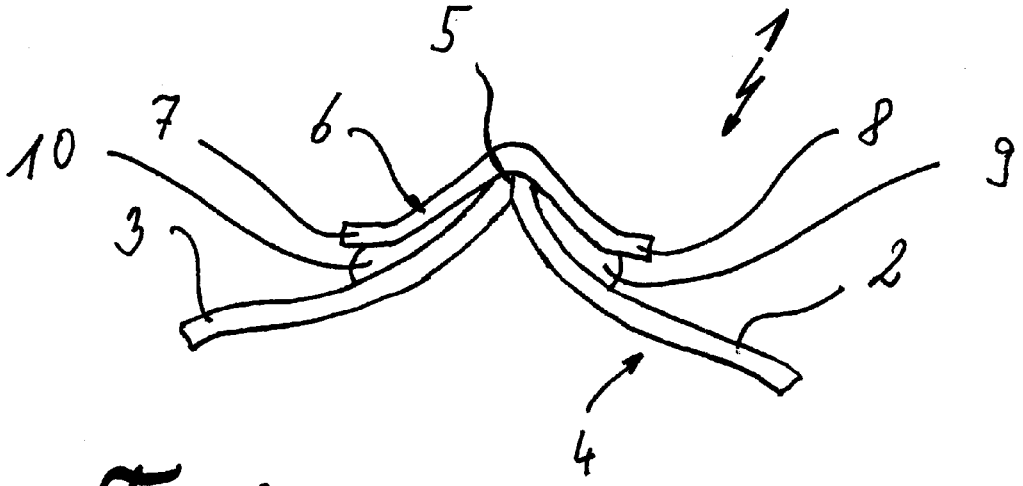
FIG. 1 shows a section through a metallic fabric in the vicinity of the welded seam.
Figure 2:
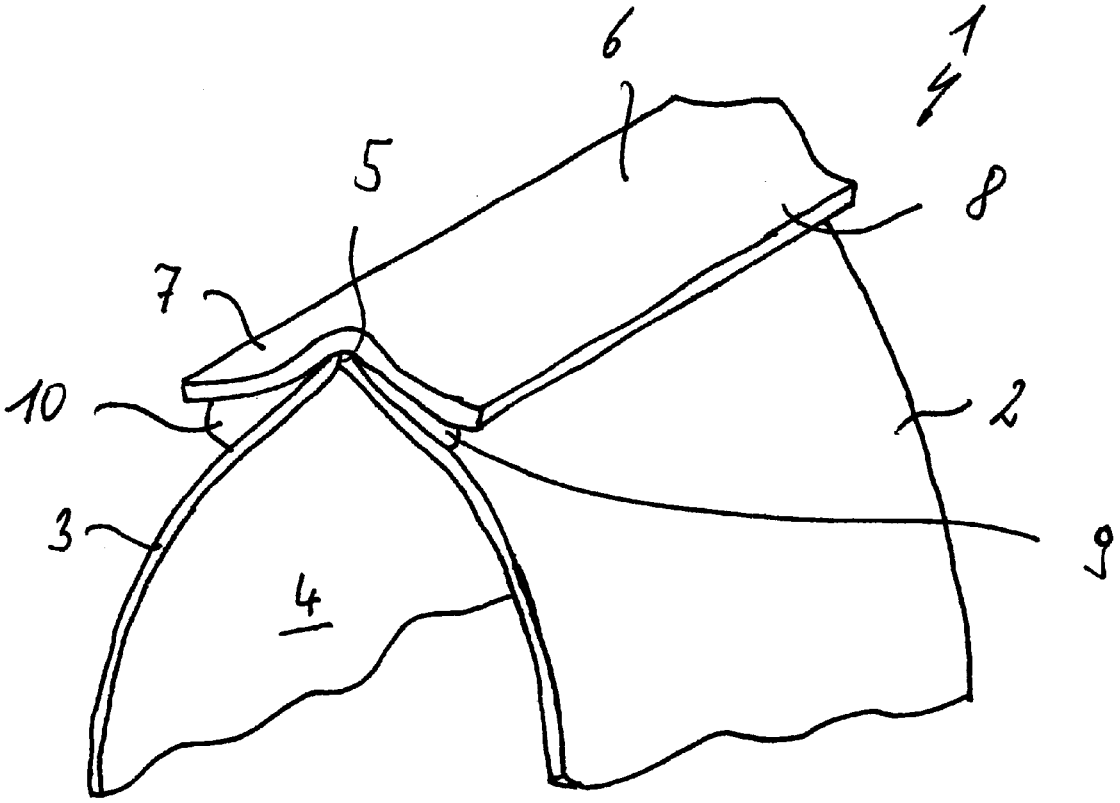

This metallic strip 6 is angled along its center line in an obtuse angle, so that the metallic strip lies over the edge areas from the metallic fabric welded together. The longitudinal edges of the metallic strip are bent out in an obtuse angle from edge areas 2 or 3 of the metallic fabric, by means of which wings 7 and 8 are formed. These bent-out wings 7 and 8 ensure that the edges of metallic strip 6 do not impact on the metallic fabric with inner pressure on hollow body 4 and cause a bend in the metallic fabric. In addition, they facilitate injection of an elastic mass 9, 10 which is injected on both sides of welded seam 5 between metallic strip 6 and metallic fabric 2, 3.

In the present case, the two edge areas 2 and 3 of the metallic fabric are edges of a filter tube formed almost circular in the assembled state. Edge areas 2 and 3 are pressed against metallic strip 6 during installation of the filter tube, by means of which elastic material 9, 10 is compressed. To clean the filter tube it is alternately impacted from the inside and externally with compressed air and these vibrations result in the fact that the distance between metallic strip 6 and edge areas 2 and 3 is periodically enlarged and diminished. These vibrations do not work directly on welded seam 5 through the injected elastic material 9, 10, rather they lead to compression of the elastic material. The elastic material and the elasticity of the metallic strip are laid out such that the resulting vibrations are transformed as completely as possible into deformation energy before they reach welded seam 5. The load of welded seam is thereby clearly reduced, thus increasing the working life of the filter tube.

What is claimed is:

1. A metallic fabric having two edge areas welded together into a hollow body, characterized in that a metallic strip is welded in the vicinity of the welded seam, the width of the welded seam is narrower than the width of the metallic strip, and the metallic strip is formed as angled sheet iron with an obtuse angle.

2. A metallic fabric having two edge areas welded together into a hollow body, characterized in that a metallic strip is welded in the vicinity of the welded seam, the width of the welded seam is narrower than the width of the metallic strip, and the metallic strip comprises wings on both sides of the welded seam and at a distance from the metallic fabric.

3. A metallic fabric as claimed in claim 2, characterized in that an obtuse angle or an arc is formed between the metallic strip and wing.

4. A metallic fabric having two edge areas welded together into a hollow body, characterized in that a metallic strip is welded in the vicinity of the welded seam, the width of the welded seam is narrower than the width of the metallic strip, and a ductile material is arranged between the metallic strip and the metallic fabric.

5. A metallic fabric as claimed in claim 4, characterized in that the ductile material is elastic.

6. A manufacturing process for a hollow body made of a metallic fabric, in which two opposite edges of the metallic fabric are welded together, characterized in that a metallic strip extending along the welded seam is welded on as the edges are welded together, and that an elastic material is injected in between the metallic strip and metallic fabric after the metallic strip is welded on.

7. A manufacturing process for a hollow body made of a metallic fabric, in which two opposite edges of the metallic fabric are welded together, characterized in that a metallic strip extending along the welded seam is welded on as the edges are welded together, and that an elastic material is applied to the metallic strip or the edges of the metallic fabric after the metallic strip is welded on.

* * * * *